US010400790B2

(12) United States Patent
Okada et al.

(10) Patent No.: US 10,400,790 B2
(45) Date of Patent: Sep. 3, 2019

(54) COMPRESSOR

(71) Applicant: MITSUBISHI HEAVY INDUSTRIES COMPRESSOR CORPORATION, Tokyo (JP)

(72) Inventors: Noriyuki Okada, Tokyo (JP); Nobuyori Yagi, Tokyo (JP); Eiichi Yanagisawa, Tokyo (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 47 days.

(21) Appl. No.: 15/575,245

(22) PCT Filed: May 21, 2015

(86) PCT No.: PCT/JP2015/064551
§ 371 (c)(1),
(2) Date: Nov. 17, 2017

(87) PCT Pub. No.: WO2016/185592
PCT Pub. Date: Nov. 24, 2016

(65) Prior Publication Data

US 2018/0135647 A1 May 17, 2018

(51) Int. Cl.
*F04D 17/12* (2006.01)
*F04D 29/28* (2006.01)
(Continued)

(52) U.S. Cl.
CPC ..... *F04D 29/444* (2013.01); *F04D 17/122* (2013.01); *F04D 29/284* (2013.01); *F04D 29/4206* (2013.01)

(58) Field of Classification Search
CPC .. F04D 17/122; F04D 29/284; F04D 29/4206; F04D 29/444
See application file for complete search history.

(56) References Cited

U.S. PATENT DOCUMENTS 5,344,285 A * 9/1994 O'Sullivan ..... F04D 1/066 415/199.2
5,735,672 A * 4/1998 Mrotek ..... B23K 9/028 416/213 A
(Continued)

FOREIGN PATENT DOCUMENTS

JP S55-100094 U 7/1980
JP S56-162298 A 12/1981
(Continued)

OTHER PUBLICATIONS

International Search Report for corresponding Japanese Application No. PCT/JP2015/064551, dated Aug. 18, 2015 (4 pages).
(Continued)

*Primary Examiner* — Igor Kershteyn
(74) *Attorney, Agent, or Firm* — Osha Liang LLP

(57) ABSTRACT

A compressor includes: an impeller attached to a rotation shaft; and a casing covering the impeller from the outside of the rotation shaft in a radial direction. The casing includes a plurality of stationary members that are connected to each other in an axial direction of the rotation shaft and in which a flow path-forming surface is toward the axial direction is formed. The flow path-forming surfaces of two stationary members adjacent in the axial direction face each other to form a flow path extending in the radial direction of the rotation shaft. At least one stationary member in the axial direction among the adjacent stationary members includes: a stationary member main body in which the flow path-forming surface is formed.

9 Claims, 11 Drawing Sheets

(51) Int. Cl.
*F04D 29/42* (2006.01)
*F04D 29/44* (2006.01)

(56) References Cited

U.S. PATENT DOCUMENTS 6,547,520 B2 * 4/2003 Zinsmeyer ..... F04D 27/0246 415/150
6,884,037 B2 * 4/2005 Lacey ..... F04D 29/2222 416/214 R
7,670,107 B2 * 3/2010 Barthelet ..... F01D 17/165 29/889.2
8,157,517 B2 * 4/2012 Feher ..... F04D 17/122 415/199.2
8,197,195 B2 * 6/2012 Lombard ..... F01D 17/143 415/158
2006/0280609 A1 * 12/2006 Ranz ..... B23P 15/006 416/182
2012/0148391 A1 6/2012 Ibaraki et al.
2015/0267710 A1 * 9/2015 Nagai ..... F04D 29/057 415/170.1
2016/0017888 A1 * 1/2016 Nakaniwa ..... F04D 17/12 415/203

FOREIGN PATENT DOCUMENTS

JP S61-079900 A 4/1986
JP S62-251498 A 11/1987
JP H02-028597 U 2/1990
JP 2011-064118 A 3/2011
JP 2013-174230 A 9/2013

OTHER PUBLICATIONS

Written Opinion for corresponding Japanese Application No. PCT/JP2015/064551, dated Aug. 18, 2015 (9 pages).

* cited by examiner

COMPRESSOR

TECHNICAL FIELD

The present invention relates to a compressor.

BACKGROUND ART

A centrifugal compressor causes a working fluid to flow inside an impeller that rotates and compresses the working fluid using centrifugal force generated when the impeller rotates. As a centrifugal compressor, a multistage centrifugal compressor including a plurality of impellers and thus gradually compressing a working fluid and a geared compressor in which impellers are attached to ends of a plurality of pinion shafts are known.

As a structure including such a centrifugal compressor, for example, a compressor unit in which three centrifugal compressors are combined through gears is described in Patent Literature 1. The centrifugal compressor of the compressor unit described in Patent Literature 1 includes a flow path width-adjusting unit for adjusting a flow path width of an annular flow path connected to a scroll flow path. The flow path width-adjusting unit includes a disk plate fixed to a casing by a bolt and a shim for adjusting a protruding amount of the disk plate in the annular flow path. In the flow path width-adjusting unit, when the thickness of the shim is selected, a protruding amount of the disk plate with respect to the annular flow path is regulated and thus the flow path width is adjusted.

CITATION LIST

Patent Literature

[Patent Literature 1]

Japanese Unexamined Patent Application, First Publication No. 2013-174230

In a multistage centrifugal compressor, a plurality of diaphragms are integrally connected side by side in an axial direction of a rotation shaft inside a casing. Flow paths such as a suction flow path, a diffuser flow path, a curved flow path, a return flow path, and a discharge flow path through which a working fluid flows are formed in a plurality of diaphragms.

When a compressed working fluid flows through the flow path, a pressure difference occurs inside the casing. Thus, a thrust force is applied to the plurality of diaphragms in an axial direction, and high stress is locally generated in a contact part between adjacent diaphragms.

However, when all of the diaphragms are made of a material with high strength in order to ensure reliable strength in response to high stress, processing becomes difficult, and processing costs increase significantly.

SUMMARY OF INVENTION

One or more embodiments of the present invention provide a compressor and a stationary member through which it is possible to ensure reliable strength while reducing processing costs.

A compressor according to one or more embodiments of the present invention includes an impeller attached to a rotation shaft; and a casing covering the impeller from the outside of the rotation shaft in a radial direction, wherein the casing includes a plurality of stationary members which are connected to each other in an axial direction of the rotation shaft and in which a flow path-forming surface is toward the axial direction is formed, wherein, among the plurality of stationary members, the flow path-forming surfaces of two stationary members adjacent in the axial direction face each other, and thus a flow path extending in the radial direction of the rotation shaft is formed, and wherein at least one stationary member in the axial direction among the adjacent stationary members includes a stationary member main body in which the flow path-forming surface is formed, and a guide part which is made of a material with higher strength than that of the stationary member main body is provided on the flow path-forming surface, and guides a fluid that flows through the flow path.

In one or more embodiments of such a configuration, when a guide part provided in the flow path is made of a material with high strength and a flow path-forming surface of another adjacent stationary member comes in contact with the guide part, even if high stress is locally generated in the guide part, it is possible to ensure reliable strength. In addition, when the guide part is made of a material with higher strength than the stationary member main body, it is possible to reduce a region for which processing is difficult in the stationary member.

In a compressor according to one or more embodiments of the present invention, the flow path-forming surface is connected to an end in the axial direction of an impeller-facing surface of the stationary member main body opposed to a radially outwardly facing surface of the impeller and is toward the axial direction, so as to define a part of the flow path, and the guide part may include a wing body that is provided to protrude in the axial direction relative to the flow path-forming surface and is disposed in the flow path.

In one or more embodiments of such a configuration, a wing body in which high stress is generated during contact with another adjacent stationary member can be made of a material with high strength. Thus, it is possible to ensure reliable strength of a stationary member with high accuracy.

In a compressor according to one or more embodiments of the present invention, the guide part may include a pedestal part which is connected to one end of the wing body in an extension direction, extends in a circumferential direction of the rotation shaft, and is fixed to the stationary member main body, and the pedestal part may be formed such that an area of one end surface in the axial direction is larger than a sectional area in a surface orthogonal to the wing body in the axial direction.

In one or more embodiments of such a configuration, according to the pedestal part in which an area of one end surface in the axial direction is formed to be larger than a sectional area in a surface orthogonal to the wing body in the axial direction, the stationary member main body and the guide part are fixed. Therefore, it is possible to reduce stress received by the stationary member main body through the guide part.

In a compressor according to one or more embodiments of the present invention, the guide part may include a receiving part (used interchangeably with "receiver") which is connected to the other end of the wing body in the extension direction and extends in the circumferential direction of the rotation shaft, and the receiving part may be formed such that an area of the other end surface in the axial direction is larger than a sectional area in a surface orthogonal to the wing body in the axial direction.

In one or more embodiments of such a configuration, the receiving part in which an area of another end surface in the axial direction is formed to be larger than a sectional area in a surface orthogonal to the wing body in the axial direction, is contact with another adjacent stationary member occurs. Therefore, it is possible to reduce stress applied to the other adjacent stationary member through the guide part.

In a compressor according to one or more embodiments of the present invention, the guide part may form a suction flow path through which the fluid flows in the impeller and a suction port through which the fluid is introduced into the suction flow path from outside of the casing.

In one or more embodiments of such a configuration, a part that receives high stress around the suction port and the suction flow path formed as a large space in the flow path can be made of a material with high strength. That is, during contact with another adjacent stationary member, in the suction flow path and the suction port, there is no contact part other than the guide part. Therefore, high stress is generated in the guide part. However, when the guide part is made of a material with high strength, it is possible to ensure reliable strength of the guide part provided in a region in which a large flow path is formed.

In a compressor according to one or more embodiments of the present invention, the stationary member main body may include a regulating part (used interchangeably with "regulator") that regulates a movement of the guide part toward the flow path in the axial direction.

In such a configuration, it is possible to determine a position of the guide part in the axial direction with respect to the flow path with high accuracy.

A stationary member according to one or more embodiments of the present invention is a stationary member in which an impeller that rotates together with a rotation shaft is housed, and when adjacent to the rotation shaft in an axial direction, flow path-forming surfaces formed in the axial direction face each other, and a flow path extending in a radial direction of the rotation shaft is formed, wherein the stationary member includes a stationary member main body in which the flow path-forming surface is formed, and a guide part which is made of a material with higher strength than that of the stationary member main body is provided on the flow path-forming surface, and guides a fluid that flows through the flow path.

According to one or more embodiments of the present invention, when the guide part is made of a material with higher strength than that of the stationary member main body, it is possible to ensure reliable strength while reducing processing costs.

DETAILED DESCRIPTION OF EMBODIMENTS

One or more embodiments of the present invention will be described below with reference to FIG. 1 to FIG. 3.

Figure 1:
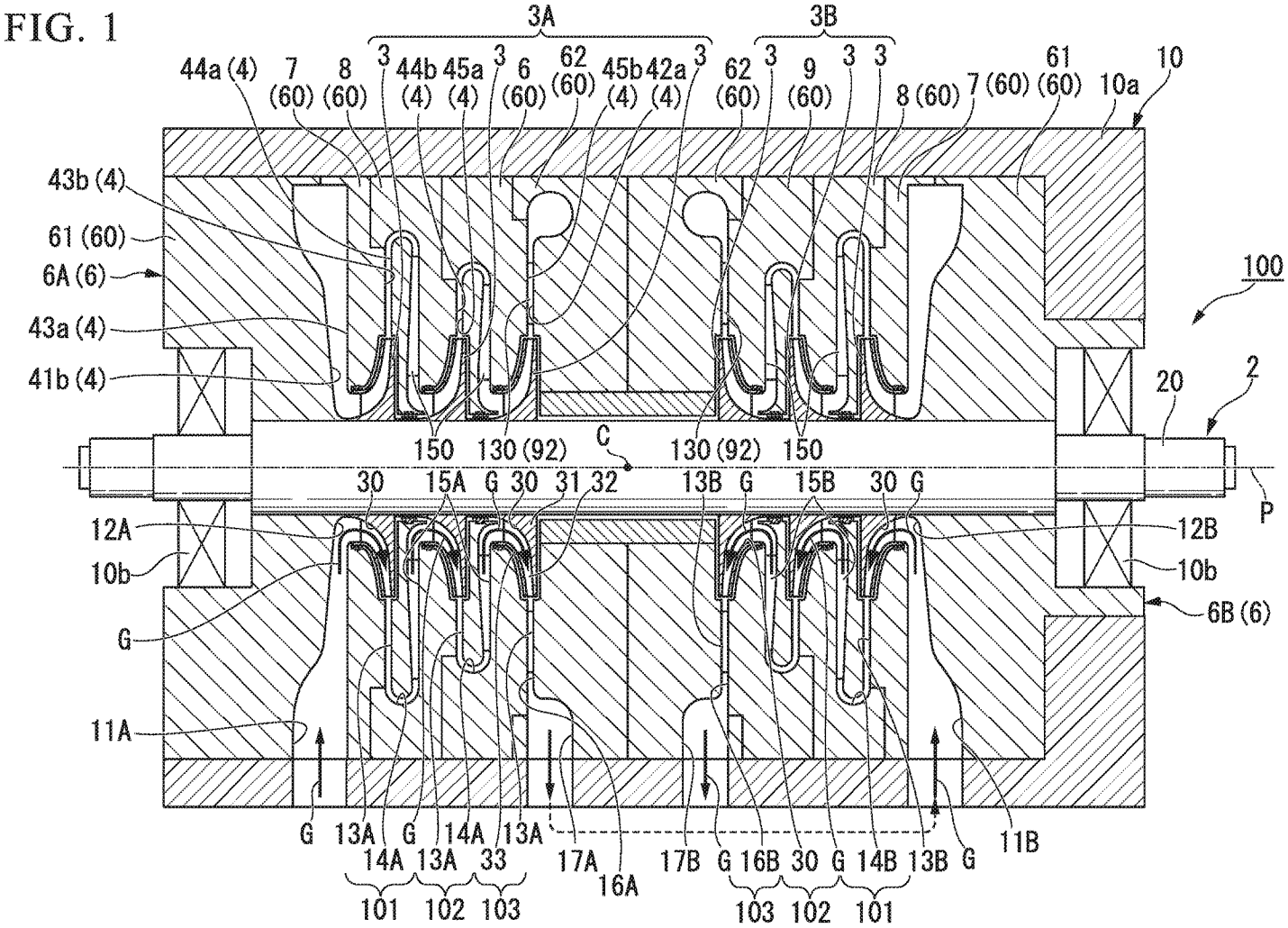
FIG. 1 is a schematic sectional view of a centrifugal compressor according to one or more embodiments of the present invention.

As shown in FIG. 1, a compressor of one or more embodiments is a uniaxial multistage centrifugal compressor 100 including a plurality of impellers 3.

The centrifugal compressor 100 includes a rotor 2 that rotates about an axis line P and a casing 10 covering the rotor 2 from the outer circumference side.

The rotor 2 includes a rotation shaft 20 that rotates about the axis line P and the plurality of impellers 3 that rotate together with the rotation shaft 20.

The rotation shaft 20 to which a driving machine (not shown) such as a motor is connected is driven to rotate by the driving machine. The rotation shaft 20 has a cylindrical shape centered on the axis line P and extends in an axial direction in which the axis line P extends. Both ends of the rotation shaft 20 in the axial direction are rotatably supported by bearings 10*b* to be described below.

The impeller 3 is attached to the rotation shaft 20, rotates together with the rotation shaft 20, and compresses a processing gas (working fluid) G using centrifugal force. A plurality of impellers 3 are attached to the rotation shaft 20. The impeller 3 of one or more embodiments is disposed between the bearings 10*b* disposed on both sides in the axial direction with respect to the rotation shaft 20. The impeller 3 is a so-called closed type impeller that includes a disk 31, a blade 32, and a cover 33.

The disk 31 is formed in a disk shape with a diameter that gradually increases outward in a radial direction of the rotation shaft 20 toward a center position C in the axial direction of the rotation shaft 20.

The blade 32 is formed to protrude in the axial direction from the disk 31. A plurality of blades 32 are foliated at predetermined intervals in the circumferential direction of the rotation shaft 20.

The cover 33 covers the plurality of blades 32 from the side opposite to the disk 31 in the axial direction. The cover 33 is formed in a disk shape that faces the disk 31.

An impeller flow path 30 is defined by the disk 31, the blade 32, and the cover 33 inside the impeller 3. The impeller flow path 30 discharges the processing gas G that flows in from an inlet on the upstream side in the axial direction and is compressed to an outlet outward in the radial direction.

The plurality of impellers 3 constitute two sets of a three-stage first impeller group 3A and a second impeller group 3B in which the directions of the blades 32 in the axial direction are opposite to each other in the axial direction.

The centrifugal compressor 100 of one or more embodiments includes three compressor stages, namely, a first compressor stage 101 (first compressor stage), a second compressor stage 102, and a third compressor stage 103 (final compressor stage) to correspond to three impellers 3 arranged in the axial direction of the first impeller group 3A and the second impeller group 3B.

On the side on which the first impeller group 3A of the centrifugal compressor 100 is disposed, the processing gas G is gradually compressed and flows toward the downstream side in the axial direction, which is the side of the center position C with one side in the axial direction as the upstream side. On the side on which the second impeller group 3B of the centrifugal compressor 100 is disposed, the processing gas G compressed in the first impeller group 3A is gradually compressed and flows toward the downstream side in the axial direction, which is the side of the center position C with the other side in the axial direction as the upstream side. Thus, in the first impeller group 3A and the second impeller group 3B, with the center position C in the axial direction as a boundary, the upstream side and downstream side are reversed in the axial direction.

Here, one side in the axial direction is a first end side of the rotation shaft 20, and is the left side in FIG. 1. In addition, the other side in the axial direction is a second end side opposite to the first end side of the rotation shaft 20 and is the right side in FIG. 1. That is, in the first impeller group 3A, the upstream side in the axial direction is the left side in FIG. 1, and the downstream side in the axial direction is the right side in FIG. 1. On the other hand, in the second impeller group 3B, the upstream side in the axial direction is the right side in FIG. 1, and the downstream side in the axial direction is the left side in FIG. 1.

The processing gas G that is compressed on the side on which the first impeller group 3A of the centrifugal compressor 100 is disposed and has reached near the center position C of the rotation shaft 20 is introduced to the side on which the second impeller group 3B of the centrifugal compressor 100 is disposed. Then, the processing gas G is compressed on the side on which the second impeller group 3B of the centrifugal compressor 100 is disposed and reaches again near the center position C (refer to a dotted line in FIG. 1). Therefore, the side on which the first impeller group 3A of the centrifugal compressor 100 is disposed has a low pressure, and the side on which the second impeller group 3B of the centrifugal compressor 100 is disposed has a high pressure. Thus, a pressure difference is generated due to the first impeller group 3A and the second impeller group 3B with the center position C of the rotation shaft 20 as a boundary.

The casing 10 includes an external casing 10*a* that forms an exterior of the centrifugal compressor 100, a diaphragm group 6 housed inside the external casing 10*a*, and the bearings 10*b* that support the rotation shaft 20.

The external casing 10*a* is formed in a cylindrical shape. The external casing 10*a* is formed so that the central axis is coincident with the axis line P of the rotation shaft 20.

Bearings 10*b* are provided one by one on both ends of the rotation shaft 20 and rotatably supports the rotation shaft 20. These bearings 10*b* are attached to an outer diaphragm 61 (to be described below) of the diaphragm group 6.

A plurality of diaphragm groups 6 are arranged to be laminated in the axial direction so that a flow path through which the processing gas G flows is defined. The diaphragm group 6 is disposed in a space between the external casing 10*a* and the rotor 2. In the diaphragm group 6, a plurality of diaphragms 60 which are stationary members are arranged in the axial direction and connected to each other. The diaphragm group 6 of one or more embodiments includes a first diaphragm group 6A corresponding to the first impeller group 3A and a second diaphragm group 6B corresponding to the second impeller group 3B. In the diaphragm group 6, among the plurality of diaphragms 60, flow path-forming surfaces 4 formed on two of the diaphragms 60 adjacent to each other in the axial direction face each other so that a flow path extending in the radial direction is formed.

Here, as the diaphragm group 6, the first diaphragm group 6A will be described as an example. Here, the second diaphragm group 6B also has the same configuration as that of the first diaphragm group 6A.

The first diaphragm group 6A includes the outer diaphragm 61 disposed furthest upstream in the axial direction among the plurality of diaphragms 60, a first diaphragm 7 disposed on the downstream side in the axial direction of the outer diaphragm 61, a second diaphragm 8 disposed on the downstream side in the axial direction of the first diaphragm 7, a third diaphragm 9 disposed on the downstream side in the axial direction of the second diaphragm 8, and an inner diaphragm 62 disposed furthest downstream in the axial direction among the plurality of diaphragms 60. In the first diaphragm group 6A, the outer diaphragm 61, the first diaphragm 7, the second diaphragm 8, the third diaphragm 9, and the inner diaphragm 62 are laminated in this order in the axial direction and fixed to each other. The first diaphragm group 6A defined a flow path through which the processing gas G flows, in the external casing 10*a*. The first diaphragm group 6A of one or more embodiments forms at least one flow path of an inlet flow path to the impeller 3 and an outlet flow path from the impeller 3 corresponding to each compressor stage.

Here, a flow path formed by the first diaphragm group 6A will be described in order from the upstream side in the axial direction. In one or more embodiments, in the first diaphragm group 6A, in order from the upstream side from which the processing gas G flows, a suction port 11A, a suction flow path 12A, a plurality of diffuser flow paths 13A, a plurality of curved flow paths 14A, a plurality of return flow paths 15A, a discharge flow path 16A, and a discharge port 17A are defined.

The processing gas G flows into the suction flow path 12A from the outside through the suction port 11A. The processing gas G flows inside the first diaphragm group 6A from the outside of the external casing 10*a* through the suction port 11A. The suction port 11A of one or more embodiments is provided on the side of the center position C in the axial direction relative to the bearing 10*b*. The suction port 11A has a circular shape, an oval shape, or a rectangular shape that opens on the outer circumference side of the external casing 10*a*. The suction port 11A is connected to the suction flow path 12A while a flow path area gradually decreases from the outer side in the radial direction inward in the radial direction.

The suction flow path 12A forms an inlet flow path through which the processing gas G flows to the impeller 3 corresponding to the first compressor stage 101 disposed furthest upstream among the plurality of impellers 3 aligned in the axial direction from the outside together with the suction port 11A. The suction flow path 12A extends from the suction port 11A inward in the radial direction, and is connected to an inlet facing the upstream side in the axial direction of the impeller flow path 30 of the impeller 3 corresponding to the first compressor stage 101 while a direction thereof changes to the downstream side in the axial direction. In the suction flow path 12A, a shape of a cross section including the axis line P is formed as an annular shape centered on the axis line P.

The diffuser flow path 13A is an outlet flow path through which the processing gas G flowing out from the impeller 3 flows. The diffuser flow path 13A is connected to an outlet facing outward from the impeller flow path 30 in the radial direction. The diffuser flow path 13A is a flow path that extends in the radial direction and forms a straight line in a radial sectional view. The diffuser flow path 13A furthest upstream in the axial direction extends from an outlet of the impeller flow path 30 of the impeller 3 corresponding to the first compressor stage 101 outward in the radial direction and is connected to the curved flow path 14A.

The curved flow path 14A changes a flow direction of the processing gas G from a direction facing outward in the radial direction to a direction facing inward in the radial direction. That is, the curved flow path 14A is a flow path having a U-shape in a radial sectional view. Among flow paths connecting the impellers 3 adjacent to each other in the axial direction, the curved flow path 14A is provided on the outer circumference side furthest outward in the radial direction in the first diaphragm group 6A.

The return flow path 15A is an inlet flow path through which the processing gas G flowing through the curved flow path 14A flows to the impeller 3. The return flow path 15A extends in a straight line in a radial sectional view inward in the radial direction while a flow path width thereof gradually widens. The return flow path 15A changes a flow direction of the processing gas G toward the downstream side in the axial direction inside the first diaphragm group 6A in the radial direction. The return flow path 15A furthest upstream in the axial direction is connected to an inlet facing the upstream side in the axial direction of the impeller flow path 30 corresponding to the second compressor stage 102 disposed on the downstream side in the axial direction. In the return flow path 15A, a plurality of return vanes 150 having a wing shape in a cross section are provided in the circumferential direction and cross the flow path.

The return vane 150 changes a direction of the processing gas G from the curved flow path 14A in the return flow path 15A to a desired direction and guides the processing gas G to the impeller flow path 30. A desired direction of the return vane 150 of one or more embodiments means, for example, a direction in which a turning component of the processing gas G from the impeller flow path 30 of the impeller 3 is removed, that is, a direction inclined to the rear side in the rotation direction of the impeller 3 with respect to the radial direction.

Since the diffuser flow path 13A, the curved flow path 14A, and the return flow path 15A formed around the impeller 3 corresponding to the second compressor stage 102 disposed on the downstream side relative to the impeller 3 corresponding to the first compressor stage 101 have the same configurations as the flow paths around the impeller 3 corresponding to the above first compressor stage 101, descriptions thereof will be omitted. In addition, since the diffuser flow path 13A around the impeller 3 corresponding to the third compressor stage 103 has the same configuration as that around the impeller flow path 30 corresponding to the first compressor stage 101, descriptions thereof will be omitted.

The discharge flow path 16A is connected to the diffuser flow path 13A connected to an outlet of the impeller flow path 30 of the impeller 3 corresponding to the third compressor stage 103. The discharge flow path 16A extends from the diffuser flow path 13A outward in the radial direction, and is connected to the discharge port 17A.

The discharge port 17A together with the discharge flow path 16A is an outlet flow path through which the processing gas G flows out from the impeller 3 corresponding to the third compressor stage 103 disposed on the most downstream side to the outside among a plurality of impellers 3 arranged in the axial direction. The processing gas G from the inside of the first diaphragm group 6A is discharged outside of the external casing 10*a* through the discharge port 17A. The discharge port 17A has a circular shape, an oval shape, or a rectangular shape that opens on the outer circumference side of the external casing 10*a*. The discharge port 17A is provided on the upstream side in the axial direction relative to the center position C.

Similar to the first diaphragm group 6A, in the second diaphragm group 6B, as a flow path therein, in order from the upstream side from which the processing gas G flows, a suction port 11B, a suction flow path 12B, a plurality of diffuser flow paths 13B, a plurality of curved flow paths 14B, a plurality of return flow paths 15B, a discharge flow path 16B, and a discharge port 17B are defined. A flow path of the second diaphragm group 6B is formed at a position symmetrical in the axial direction with respect to a flow path of the first diaphragm group 6A with the center position C in the axial direction as a boundary.

In the outer diaphragm 61, a flow path-forming surface 41*b* is formed to face the downstream side in the axial direction. The outer diaphragm 61 houses the bearing 10*b* inside in the radial direction.

In the inner diaphragm 62, a flow path-forming surface 42*a* is formed to face the upstream side in the axial direction. The inner diaphragm 62 is made of the same material as that of the outer diaphragm 61.

The first diaphragm 7 is provided to correspond to the first compressor stage 101 among compressor stages of the centrifugal compressor 100. The first diaphragm 7 is adjacent to the downstream side in the axial direction of the outer diaphragm 61 and is adjacent to the upstream side in the axial direction of the second diaphragm 8. In the first diaphragm 7, a flow path-forming surface 43*a* which is toward the upstream side in the axial direction and a flow path-forming surface 43*b* which is toward the downstream side in the axial direction are formed. In the first diaphragm 7, the flow path-forming surface 43*a* faces the flow path-forming surface 41*b* of the outer diaphragm 61 in the axial direction and thus the suction port 11A and the suction flow path 12A are formed. A space in which the impeller 3 can be housed is formed inside the first diaphragm 7 in the radial direction.

The second diaphragm 8 is provided to correspond to the second compressor stage 102 among compressor stages of the centrifugal compressor 100. The second diaphragm 8 is adjacent to the upstream side in the axial direction of the third diaphragm 9. In the second diaphragm 8, a flow path-forming surface 44*a* which is toward the upstream side in the axial direction and a flow path-forming surface 44*b* which is toward the downstream side in the axial direction are formed. In the second diaphragm 8, the flow path-forming surface 44*a* faces the flow path-forming surface 43*b* of the first diaphragm 7 in the axial direction, and thus the diffuser flow path 13A through which the processing gas G discharged from the impeller 3 corresponding to the first compressor stage 101 flows is formed. The curved flow path 14A and the return flow path 15A through which the processing gas G flows to the impeller 3 corresponding to the second compressor stage 102 are formed inside the second diaphragm 8. A space in which the impeller 3 can be housed is formed inside the second diaphragm 8 in the radial direction.

The third diaphragm 9 is provided to correspond to the third compressor stage 103 among compressor stages of the centrifugal compressor 100. The third diaphragm 9 is adjacent to the upstream side in the axial direction of the inner diaphragm 62. In the third diaphragm 9, a flow path-forming surface 45*a* which is toward the upstream side in the axial direction and a flow path-forming surface 45*b* which is toward the downstream side in the axial direction are formed. In the third diaphragm 9, the flow path-forming surface 45*a* faces the flow path-forming surface 44*b* of the second diaphragm 8 in the axial direction and thus the diffuser flow path 13A through which the processing gas G discharged from the impeller 3 corresponding to the second compressor stage 102 flows is formed. In the third diaphragm 9, the flow path-forming surface 45*b* faces the flow path-forming surface 42*a* of the inner diaphragm 62 in the axial direction, and thus the diffuser flow path 13A, the discharge flow path 16A, and the discharge port 17A through which the processing gas G discharged from the impeller 3 corresponding to the third compressor stage 103 flows are formed. The curved flow path 14A and the return flow path 15A through which the processing gas G flows to the impeller 3 corresponding to the third compressor stage 103 are formed inside the third diaphragm 9. A space in which the impeller 3 can be housed is formed inside the third diaphragm 9 in the radial direction.

In the first diaphragm group 6A of one or more embodiments, among the diaphragms 60 which are adjacent stationary members in the axial direction, at least one diaphragm 60 includes a stationary member main body 91, a guide part 92 that protrudes from the stationary member main body 91, and a fixing part 93 for fixing the guide part 92 to the stationary member main body 91.

Figure 2:
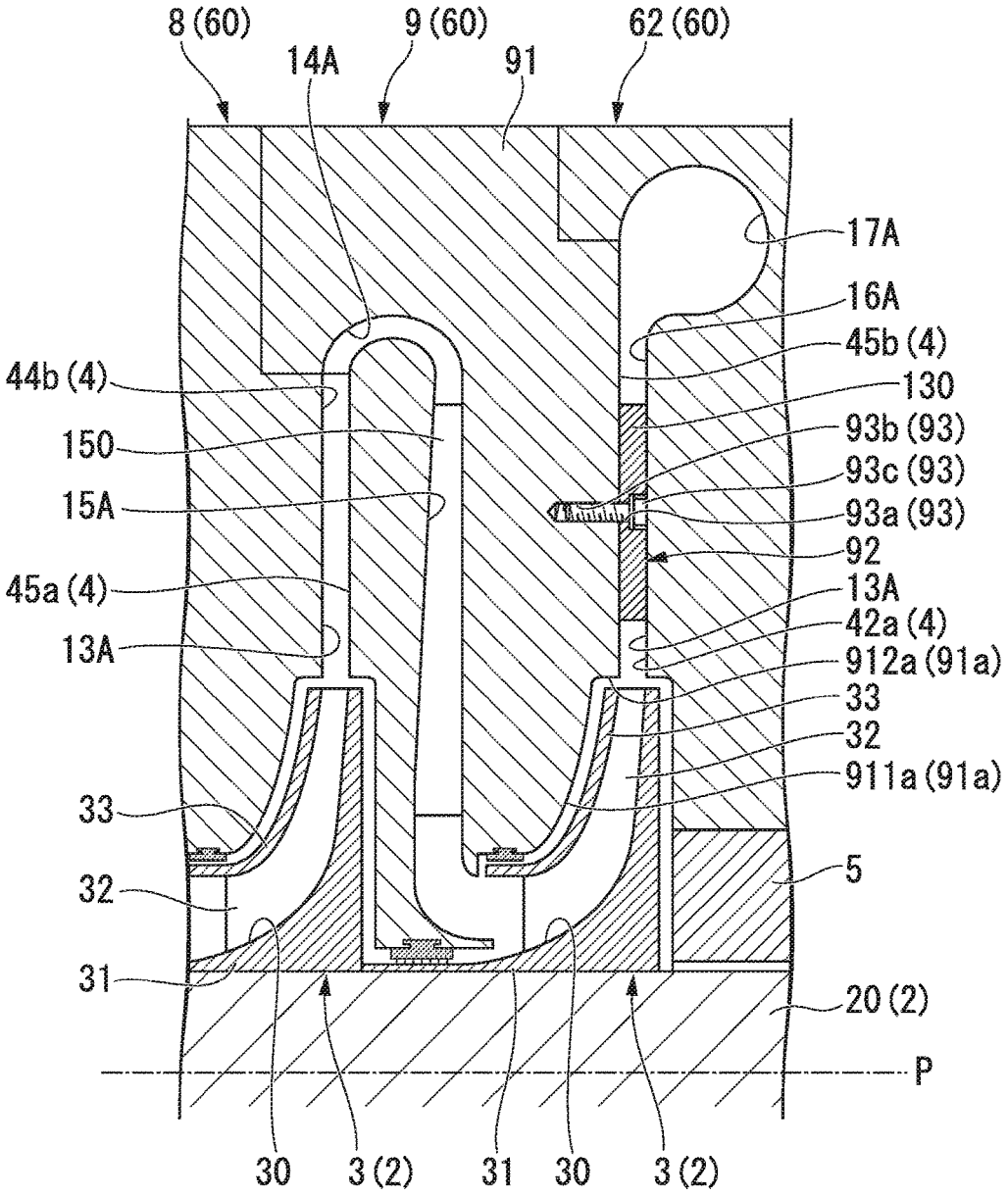
FIG. 2 is a main part sectional view describing a third diaphragm according to one or more embodiments of the present invention.
Figure 3:
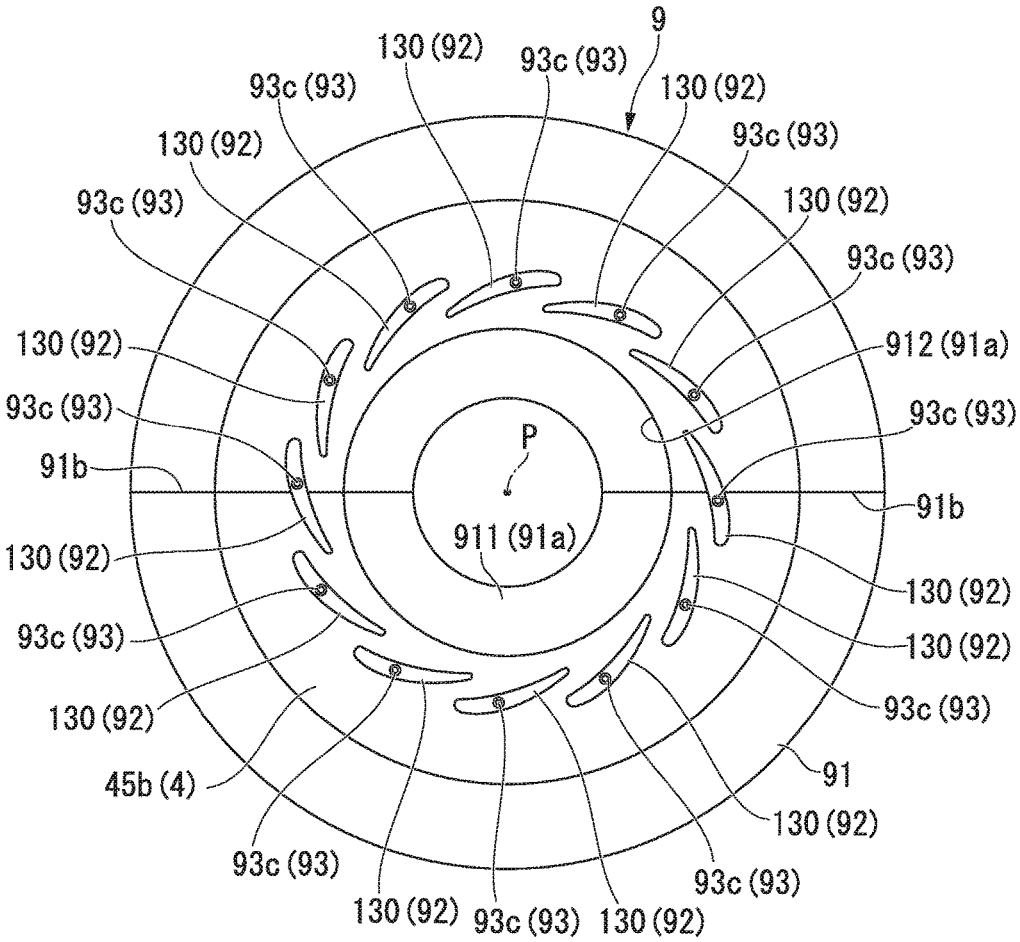
FIG. 3 is a schematic diagram of the third diaphragm according to one or more embodiments of the present invention viewed from the downstream side in an axial direction.

In one or more embodiments, as adjacent diaphragms 60, as shown in FIG. 2, the third diaphragm 9 and the inner diaphragm 62 of the first diaphragm group 6A will be described as an example. In one or more embodiments, one diaphragm 60 including the guide part 92 in the axial direction is the third diaphragm 9, and the other diaphragm 60 adjacent to the third diaphragm 9 in the axial direction is the inner diaphragm 62.

A space for housing the impeller 3 is formed inside the stationary member main body 91 in the radial direction. In the stationary member main body 91 of one or more embodiments, the curved flow paths 14A and 14B and the return flow paths 15A and 15B are formed therein. As shown in FIG. 3, the stationary member main body 91 is formed in an annular shape centered on the axis line P by combining two semicircular members at a dividing surface 91*b*, and a space in which the impeller 3 and the rotation shaft 20 are housed inside the radial direction is formed. The stationary member main body 91 of one or more embodiments is made of an inexpensive material with low strength that is easily processed.

Here, as the material with low strength in one or more embodiments, for example, general carbon steel such as SS400 and S45C may be exemplified.

As shown in FIG. 2, the stationary member main body 91 includes an impeller-facing surface 91*a* facing inward in the radial direction, the flow path-forming surface 45*a* that defines a part of the flow path when facing the upstream side in the axial direction, and the flow path-forming surface 45*b* that defines a part of the flow path when facing the downstream side in the axial direction connected to an end of the impeller-facing surface 91*a* in the axial direction.

The impeller-facing surface 91*a* is a surface that defines a space in which the impeller 3 and the rotation shaft 20 are housed. The impeller-facing surface 91*a* faces a surface that is outward from the impeller 3 in the radial direction. The impeller-facing surface 91*a* of one or more embodiments includes a facing tapered surface 911*a* that faces a surface facing outward from the cover 33 in the radial direction and the upstream side in the axial direction and a facing end surface 912*a* that faces an end surface outward in the radial direction of the impeller 3 in which an outlet of the impeller flow path 30 is formed.

The facing tapered surface 911*a* is formed in a region that faces the cover 33. The facing tapered surface 911*a* is formed such that the diameter gradually increases outward in the radial direction from the upstream side in the axial direction to the downstream side.

The facing end surface 912*a* extends from an end of the facing tapered surface 911*a* on the downstream side in the axial direction to the downstream side in the axial direction. The facing end surface 912*a* is parallel to the outer circumferential surface of the rotation shaft 20 and faces inward in the radial direction.

The flow path-forming surface 45*a* is an end surface that faces the upstream side in the axial direction of the stationary member main body 91.

The flow path-forming surface 45*b* is an end surface that faces the downstream side in the axial direction of the stationary member main body 91. The flow path-forming surface 45*b* vertically extends from an end of the facing end surface 912*a* on the downstream side in the axial direction outward in the radial direction.

The guide part 92 is provided to protrude from the flow path-forming surface 45*b* to the downstream side in the axial direction. The guide part 92 guides a fluid that flows through the flow path. The guide part 92 is in contact with the inner diaphragm 62, which is another adjacent stationary member in the axial direction. The guide part 92 is made of a material with higher strength than that of the stationary member main body 91. That is, a material with higher strength level than general carbon steel, for example, SS400 and S45C, is used for the guide part 92 of one or more embodiments.

The guide part 92 of one or more embodiments is constituted only a wing body, which is a diffuser vane 130. The diffuser vane 130 extends in the axial direction and has a cross section having a wing shape that is curved to be convex outward in the radial direction. The diffuser vane 130 is disposed in the diffuser flow path 13A to protrude to the downstream side in the axial direction relative to the flow path-forming surface 45*b*. The diffuser vane 130 of one or more embodiments is disposed so that an end surface facing the downstream side in the axial direction is in contact with a surface facing the upstream side in the axial direction of the adjacent inner diaphragm 62. As shown in FIG. 3, a plurality of diffuser vanes 130 are provided in the circumferential direction centered on the axis line P.

The fixing part 93 fixes the guide part 92 to the stationary member main body 91 using a fastening member such as a bolt 93*c*. The fixing part 93 fixes the diffuser vane 130 to the stationary member main body 91 and thus regulates a position with respect to the stationary member main body 91 of the guide part 92. As shown in FIG. 2, the fixing part 93 of one or more embodiments includes a wing through-hole 93*a* through which the diffuser vane 130 penetrates in the axial direction, a bolt-fixing hole 93*b* formed on the flow path-forming surface 45*b*, and the bolt 93*c* that is inserted into the wing through-hole 93*a* and fixed to the bolt-fixing hole 93*b*. The fixing part 93 directly fixes the diffuser vane 130 to the stationary member main body 91 while an end surface of the diffuser vane 130 on the upstream side in the axial direction is in contact with the flow path-forming surface 45*b*. The bolt 93*c* is disposed such that it does not protrude from the end surface of the diffuser vane 130 on the downstream side in the axial direction. Thus, the fixing part 93 fixes the diffuser vane 130 so that the end surface of the diffuser vane 130 on the downstream side in the axial direction comes in contact with the flow path-forming surface 42*a* of the inner diaphragm 62.

In the centrifugal compressor 100 described above, when the processing gas G compressed in the flow path formed inside the first diaphragm group 6A and the second diaphragm group 6B flows, a pressure increases toward the downstream side of the flow path. Specifically, as shown in FIG. 1, on the side of the first diaphragm group 6A, the processing gas G flowing in from the suction port 11A flows from the suction flow path 12A to the impeller flow path 30 of the impeller 3 of the first compressor stage 101, the diffuser flow path 13A, the curved flow path 14A, and the return flow path 15A in that order, and then flows while being compressed in the second compressor stage 102 and the third compressor stage 103 in that order. The processing gas G flowing out from the diffuser flow path 13A of the third compressor stage 103 is discharged outside of the external casing 10*a* from the discharge port 17A through the discharge flow path 16A and flows from the suction port 11B on the side of the second diaphragm group 6B to the inside of the external casing 10*a* again. Then, as in the side of the first diaphragm group 6A, the processing gas G flows while being compressed in the first compressor stage 101, the second compressor stage 102, and the third compressor stage 103 on the side of the second diaphragm group 6B in that order. The processing gas G flowing to the diffuser flow path 13B in the third compressor stage of the second diaphragm group 6B is discharged from the discharge port 17B to the outside through the discharge flow path 16B. Thus, in the centrifugal compressor 100 of one or more embodiments, the side of the second diaphragm group 6B is a high-pressure side, and the side of the first diaphragm group 6A is a low-pressure side. That is, in the centrifugal compressor 100 of one or more embodiments, the side of the second diaphragm group 6B relative to the center position C of the rotation shaft 20 has a higher pressure than the side of the first diaphragm group 6A.

As a result, a thrust force is generated in the axial direction from the side of the second diaphragm group 6B toward the side of the first diaphragm group 6A. Thus, high stress is generated in contact parts between the plurality of adjacent diaphragms 60 such as a contact part between the outer diaphragm 61 and the first diaphragm 7 and a contact part between the third diaphragm 9 and the inner diaphragm 62.

However, according to the centrifugal compressor 100 and the diaphragm 60 of one or more embodiments, the diffuser vane 130 constituting a contact part between the third diaphragm 9 and the inner diaphragm 62 which are adjacent to each other is made of a material with high strength. Therefore, when the flow path-forming surface 42*a* of the adjacent inner diaphragm 62 comes in contact with the diffuser vane 130, even if a very high stress is locally generated in the diffuser vane 130, it is possible to prevent the diffuser vane 130 from being deformed or broken and it is possible to ensure reliable strength of the third diaphragm 9. In addition, when the diffuser vane 130 is made of a material with higher strength than that of the stationary member main body 91, it is possible to reduce a region for which processing is difficult in the entire third diaphragm 9. Thus, it is possible to ensure reliable strength while reducing processing costs.

When only the diffuser vane 130 in the third diaphragm 9 is made of a material with high strength, since only the diffuser vane 130 is a part made of a material with high strength of which processing is difficult in the entire third diaphragm 9, it is possible to further reduce a region for which processing is difficult. Thus, it is possible to further reduce processing costs.

Next, a centrifugal compressor of one or more embodiments will be described with reference to FIG. 4 and FIG. 5.

In the one or more embodiments, components the same as those in the above-described embodiments are denoted with the same reference numerals and details thereof will be omitted. In the centrifugal compressor of one or more embodiments, a configuration of a third diaphragm, which is a stationary member, is different from that of the above-described embodiments.

In a third diaphragm 9*a* of one or more embodiments, a guide part 922 is fixed to the stationary member main body 912 via a pedestal part 94. As shown in FIG. 4, the third diaphragm 9*a* of one or more embodiments includes the guide part 922 having the pedestal part 94, the stationary member main body 912 in which a recess 95 into which the pedestal part 94 is fitted is formed, and a fixing part 932 for fixing the pedestal part 94 to the stationary member main body 912.

The pedestal part 94 is connected to an end on the upstream side in the axial direction, which is one end in an extension direction of the diffuser vane 130, which is a wing body. In the pedestal part 94, an area of an end surface on the upstream side, which is one in the axial direction, is formed to be larger than a sectional area of the diffuser vane 130 in a radial cross section including the axis line P, which is a cross section in a surface orthogonal in the axial direction. The pedestal part 94 extends in the circumferential direction of the rotation shaft 20 and is fixed to the stationary member main body 912. Both sides of the pedestal part 94 in the radial direction are formed to be longer than those of the diffuser vane 130. As shown in FIG. 5, the pedestal part 94 of one or more embodiments extends in the circumferential direction and forms a semicircular shape centered on the axis line P when viewed from the downstream side in the axial direction. The pedestal part 94 is integrally formed with and with the same material as that of the plurality of diffuser vanes 130. That is, the plurality of diffuser vanes 130 of one or more embodiments are disposed to be separated from each other in the circumferential direction centered on the axis line P and are protruded form a surface of the pedestal part 94 which is toward the downstream side in the axial direction. The pedestal part 94 of one or more embodiments is made of a material with higher strength level than that of general carbon steel such as SS400 and S45C.

Figure 4:
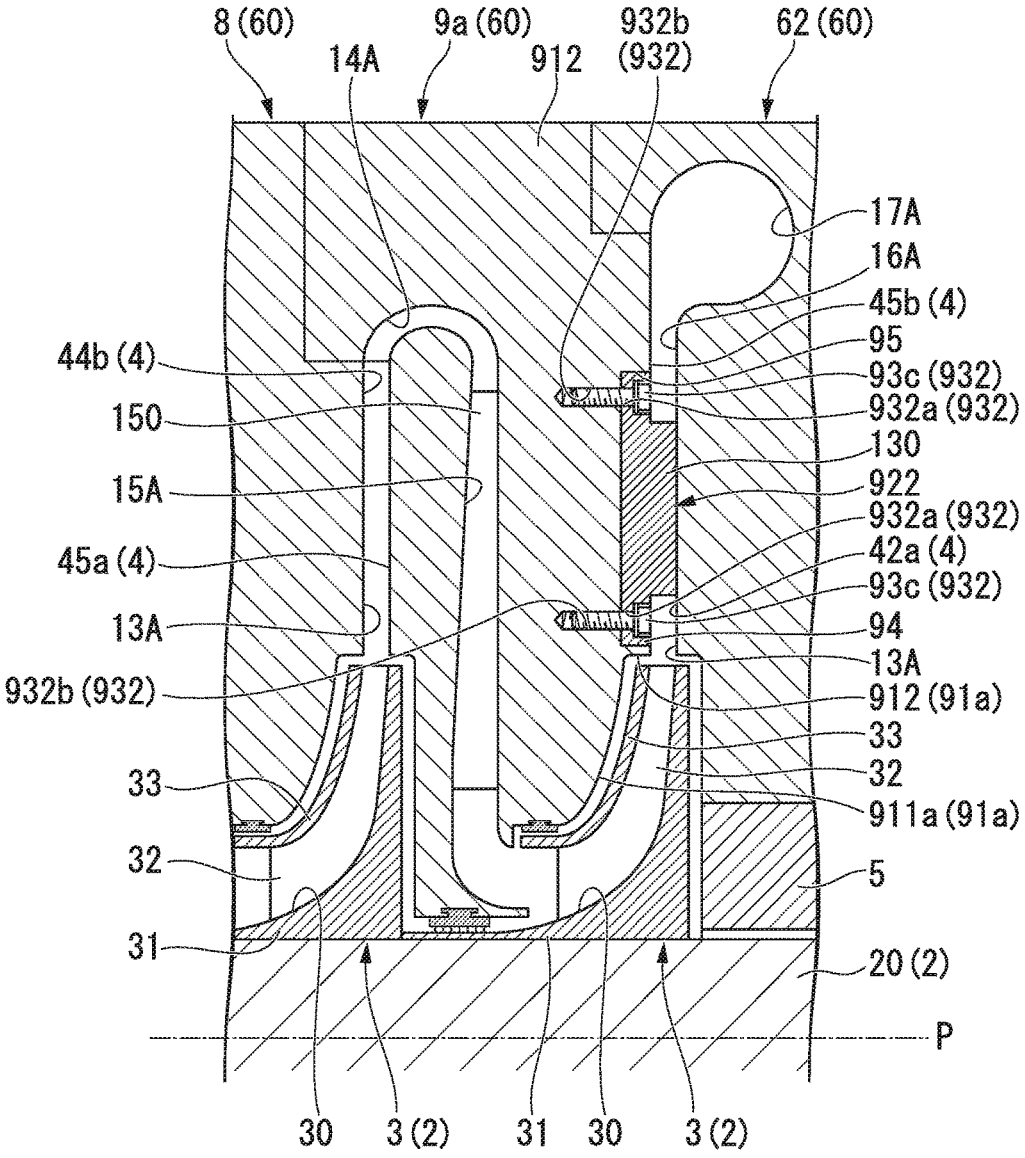
FIG. 4 is a main part sectional view describing a third diaphragm according to one or more embodiments of the present invention.
Figure 5:
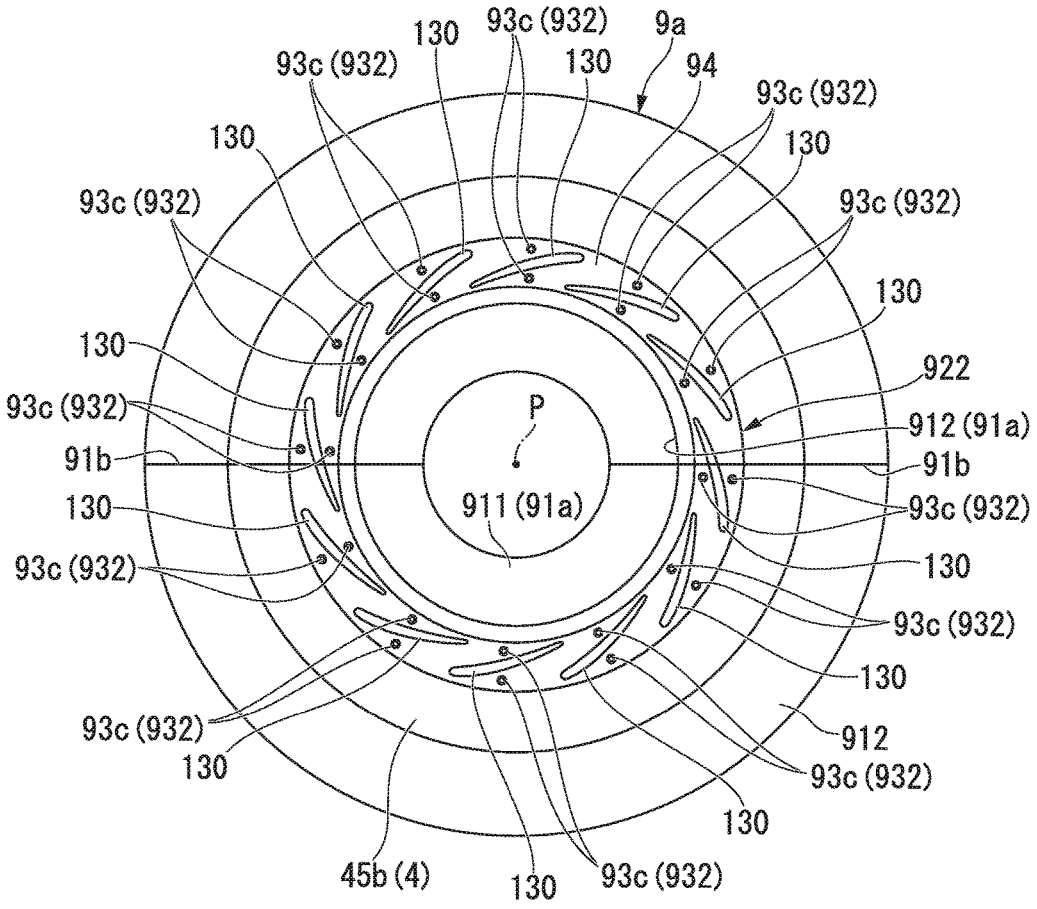
FIG. 5 is a schematic diagram of the third diaphragm according to one or more embodiments of the present invention viewed from the downstream side in an axial direction.

As shown in FIG. 4, the recess 95 is concave from the flow path-forming surface 4 to the upstream side in the axial direction so that the pedestal part 94 does not protrude into the diffuser flow path 13A. That is, the recess 95 is formed such that the pedestal part 94 is housed inside a stationary member and only the diffuser vane 130 is disposed in the diffuser flow path 13A. The recess 95 is concave in a semicircular shape centered on the axis line P according to the outer shape of the pedestal part 94.

The fixing part 932 of one or more embodiments fixes the pedestal part 94 to the stationary member main body 912, and thus regulates a position of the guide part 922 with respect to the stationary member main body 912. The fixing part 932 includes a plurality of pedestal through-holes 932*a* through which the pedestal part 94 penetrates in the axial direction, a recess bolt-fixing hole 932*b* fainted on a surface of the recess 95 which is facing the downstream side in the axial direction, and the bolt 93*c* that is inserted into the pedestal through-hole 932*a* and is fixed to the recess bolt-fixing hole 932*b*. The fixing part 932 directly fixes the pedestal part 94 to the stationary member main body 912 while an end surface of the pedestal part 94 which is facing the upstream side in the axial direction is in contact with a surface of the recess 95 which is facing the downstream side in the axial direction. The bolt 93*c* is disposed such that it does not protrude from the end surface of the pedestal part 94 on the downstream side in the axial direction into the diffuser flow path 13A.

According to the centrifugal compressor 100 and the diaphragm 60 of one or more embodiments described above, an area of the end surface of the pedestal part 94 which is facing the upstream side in the axial direction is formed to be larger than a sectional area in a radial cross section of the diffuser vane 130 including the axis line P. When the stationary member main body 912 and the guide part 922 are fixed by the pedestal part 94, compared to when the diffuser vane 130 is directly fixed to the flow path-forming surface 45*b*, it is possible to increase a contact area between the guide part 922 and the stationary member main body 912. Thus, during contact with the adjacent inner diaphragm 62, it is possible to reduce a stress received by the stationary member main body 912 through the guide part 922.

When the pedestal through-hole 932*a* for fixing is formed at the pedestal part 94 larger than the diffuser vane 130, it is possible to fix the guide part 922 to the stationary member main body 912 without processing the diffuser vane 130. That is, it is possible to ensure a space for fixing the guide part 922 to the stationary member main body 912 with the fixing part 932.

When the plurality of diffuser vanes 130 are fixed to one pedestal part 94, by simply fixing the pedestal part 94 to the stationary member main body 912, the plurality of diffuser vanes 130 can be disposed in the diffuser flow paths 13A and 13B. Thus, the guide part 922 can be easily installed to the stationary member main body 912. In addition, when the recess 95 is formed according to the outer shape of the pedestal part 94, the guide part 922 can be installed more easily.

Next, a centrifugal compressor of one or more embodiments will be described with reference to FIG. 6 and FIG. 7.

In one or more embodiments, components the same as those in the above-described embodiments are denoted with the same reference numerals and details thereof will be omitted. In the centrifugal compressor of one or more embodiments, a configuration of a third diaphragm, which is a stationary member, is different from that of the above-described embodiments.

Figure 6:
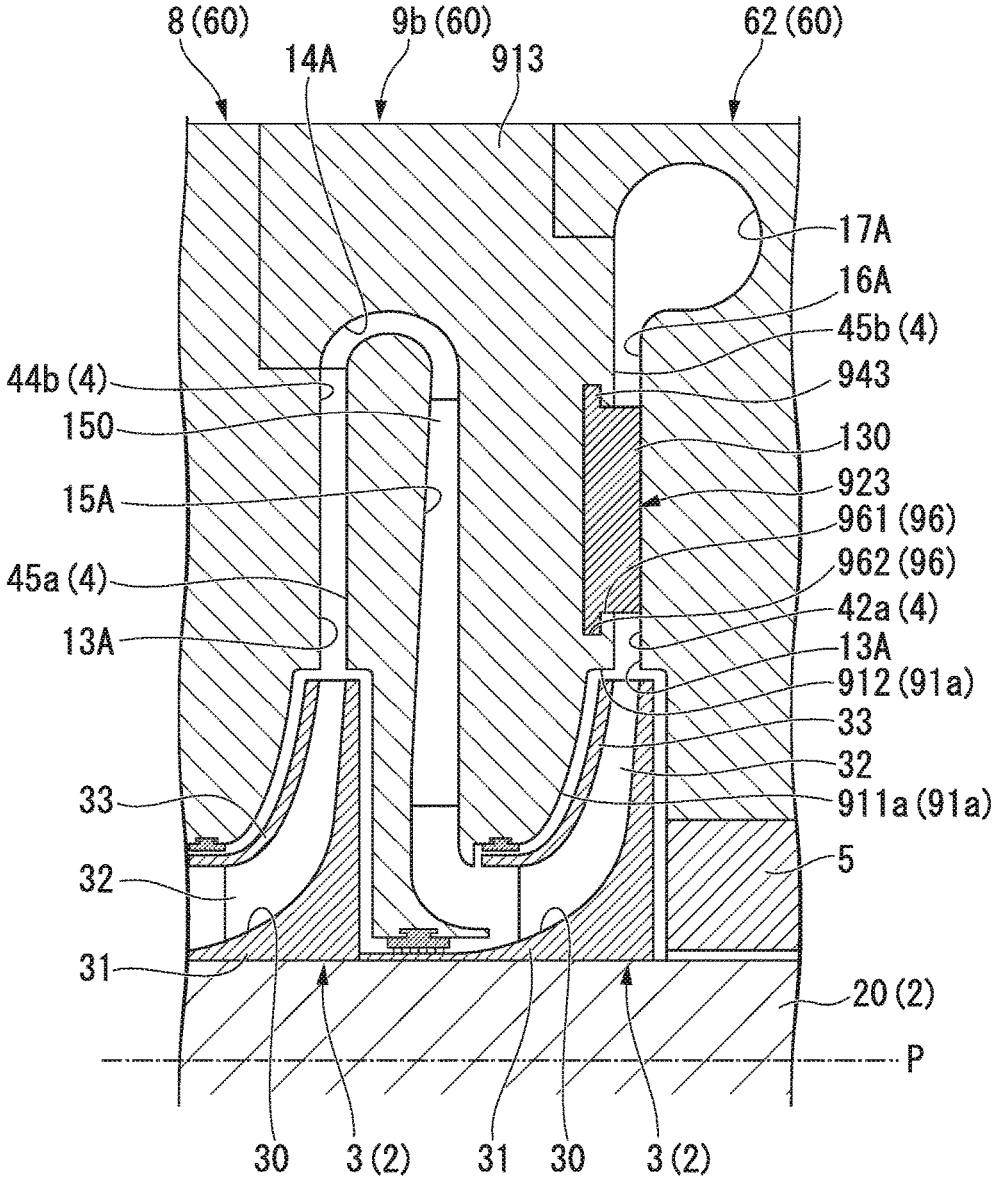
FIG. 6 is a main part sectional view describing a third diaphragm according to one or more embodiments of the present invention.
Figure 7:
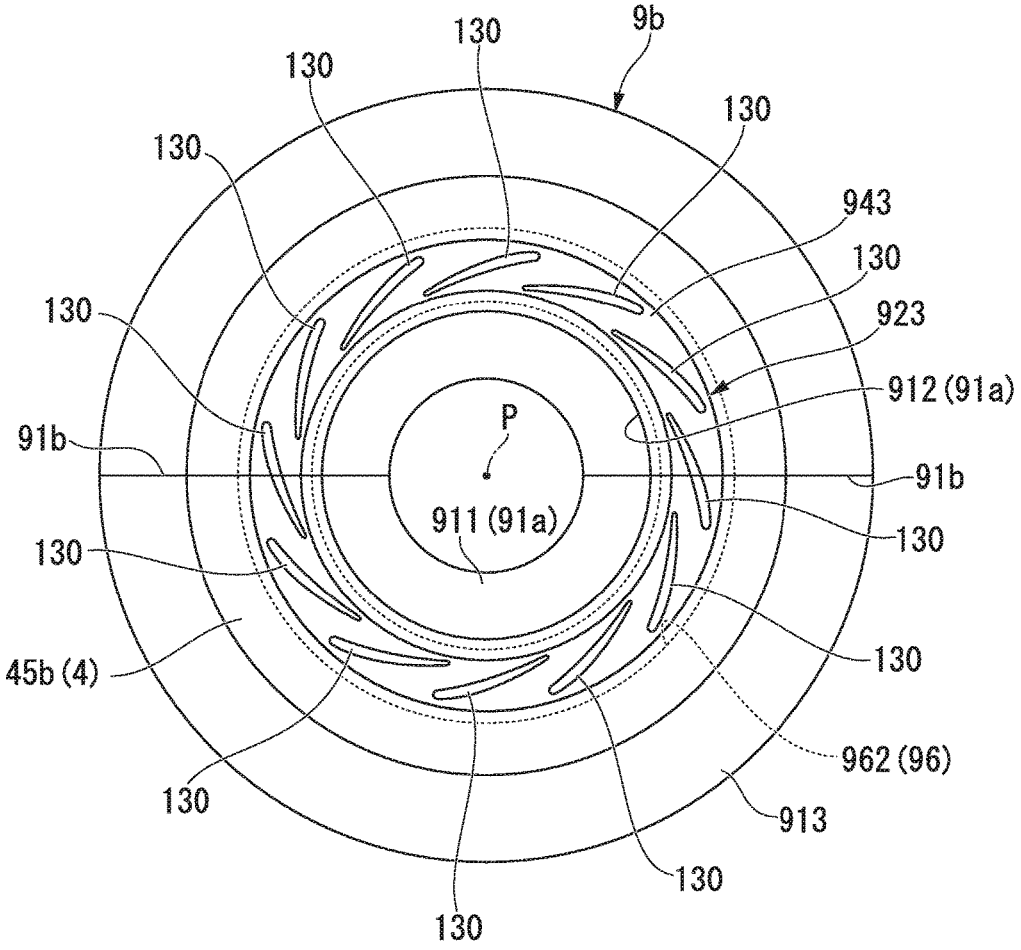
FIG. 7 is a schematic diagram of the third diaphragm according to one or more embodiments of the present invention viewed from the downstream side in an axial direction.

That is, as shown in FIG. 6, in a third diaphragm 9*b* of one or more embodiments, a stationary member main body 913 includes a regulating part 96 that regulates a movement of a guide part 923 toward the flow path in the axial direction. The stationary member main body 913 of one or more embodiments regulates a movement of the guide part 923 toward the downstream side, which is the side of the diffuser flow path in the axial direction, by the regulating part 96 without using a fastening member such as the bolt 93*c*.

The regulating part 96 regulates a position of the diffuser vane 130 in the axial direction with respect to the stationary member main body 913. The regulating part 96 is concave toward the upstream side in the axial direction from the flow path-forming surface 45*b* with respect to the stationary member main body 913 and is formed in a semicircular shape centered on the axis line P. The regulating part 96 of one or more embodiments includes a first recess 961 which opens at the flow path-forming surface 45*b*, extends to the upstream side in the axial direction, and has a radial cross section with a rectangular shape, and a second recess 962 which communicates with the first recess 961, extends in the radial direction and has a radial cross section with a rectangular shape that protrudes from the first recess 961 to both sides in the radial direction. That is, the regulating part 96 of one or more embodiments is formed as a groove which has a T-shaped cross section and into which a pedestal part 943 is fitted.

The pedestal part 943 of one or more embodiments is disposed inside the second recess 962 without a gap therebetween. That is, the pedestal part 943 is housed inside the stationary member main body 913. The pedestal part 943 is inserted from the dividing surface 91*b* of the stationary member main body 913 in the circumferential direction, and is thus fitted into the second recess 962. Thus, in the guide part 923, the pedestal part 943 is disposed inside the second recess 962, and a part of the diffuser vane 130 on the upstream side in the axial direction is housed in the first recess 961, so that only the diffuser vane 130 is exposed to the diffuser flow paths 13A and 13B rather than the flow path-forming surface 45*b*. The guide part 923 forms a semicircular shape centered on the axis line P while the pedestal part 943 is disposed inside the stationary member main body 913, and has a T-shaped cross section in which the diffuser vane 130 protrudes toward the diffuser flow path 13A.

According to the centrifugal compressor 100 and the diaphragm 60 of one or more embodiments described above, when the pedestal part 943 is fitted into the second recess 962 of the regulating part 96, it is possible to regulate a position of the diffuser vane 130 in the axial direction with respect to the flow path-forming surface 45*b*. Therefore, the diffuser vane 130 for guiding the processing gas G that flows through the diffuser flow paths 13A and 13B can be disposed at a designated position with high accuracy. Thus, a position of the guide part 923 in the axial direction with respect to the diffuser flow paths 13A and 13B can be determined with high accuracy.

By simply fitting the pedestal part 943 into the second recess 962 of the regulating part 96, it is possible to regulate a position of the guide part 923 without using a fastening member such as the bolt 93*c*.

Next, a centrifugal compressor of one or more embodiments will be described with reference to FIG. 8 and FIG. 9.

In one or more embodiments, components the same as those in the above-described embodiments are denoted with the same reference numerals and details thereof will be omitted. In the centrifugal compressor of one or more embodiments, a configuration of a third diaphragm, which is a stationary member, is different from that of the above-described embodiments.

Figure 8:
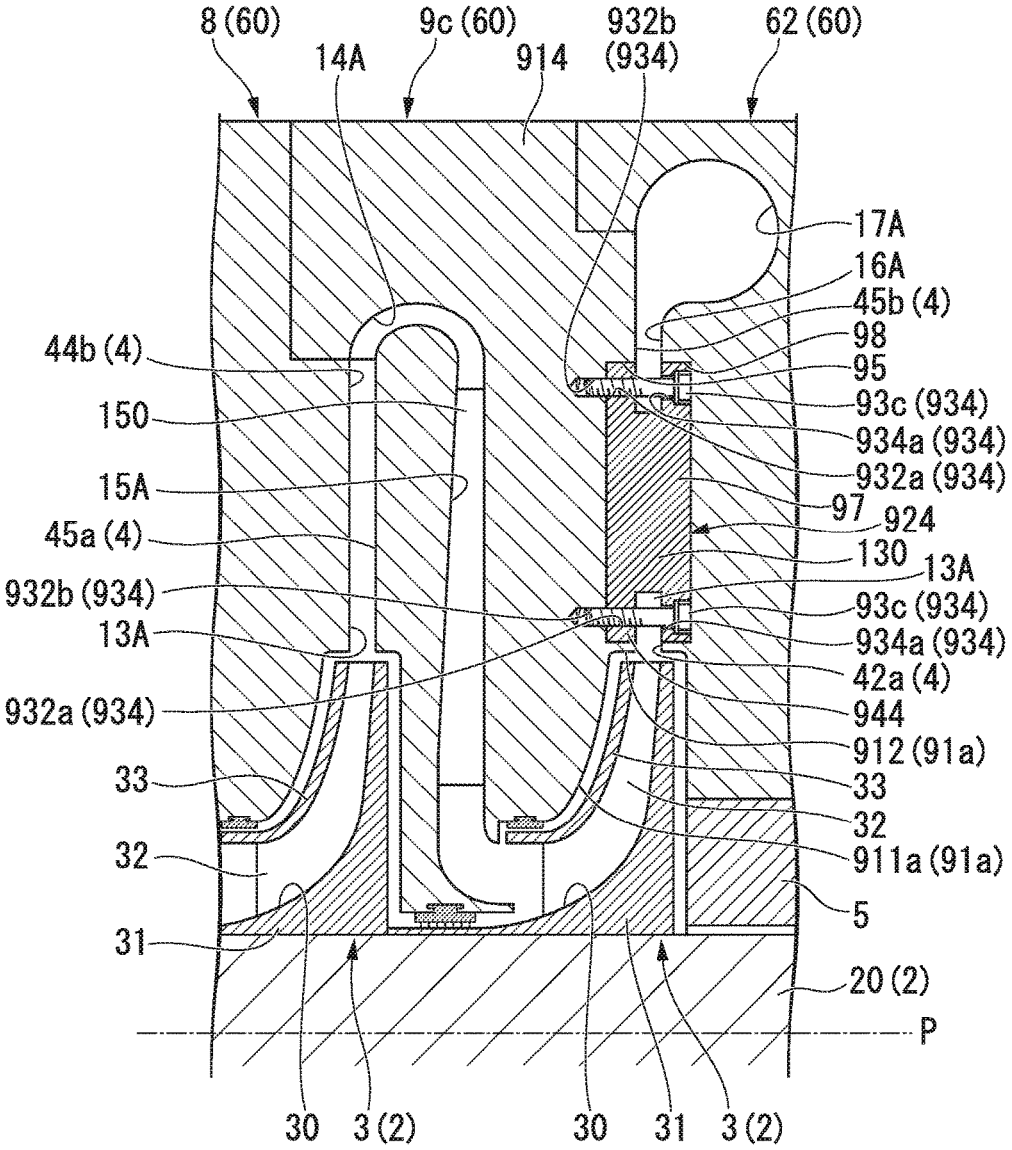
FIG. 8 is a main part sectional view describing a third diaphragm according to one or more embodiments of the present invention.
Figure 9:
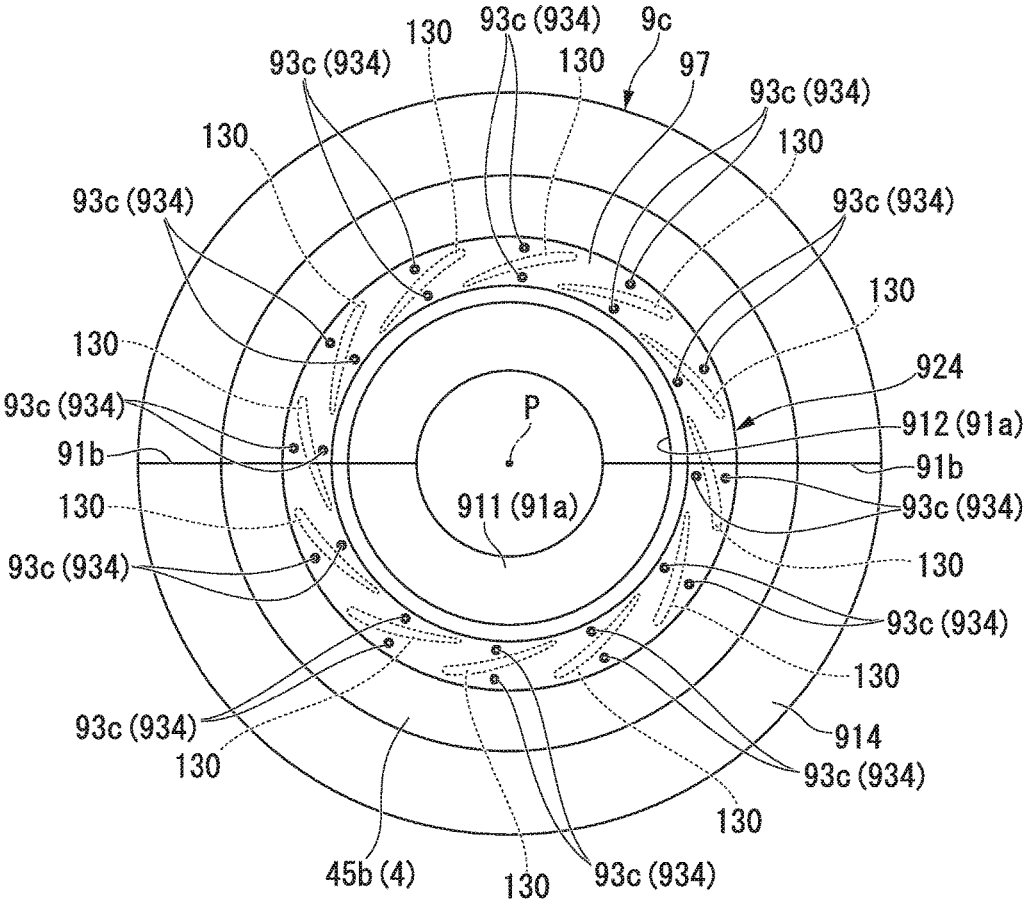
FIG. 9 is a schematic diagram of the third diaphragm according to one or more embodiments of the present invention viewed from downstream side in an axial direction.

That is, as shown in FIG. 8, in a third diaphragm 9*c* of one or more embodiments, a guide part 924 of one or more embodiments includes a receiving part 97 which is connected to the diffuser vane 130 and comes in contact with the inner diaphragm 62, which is another adjacent stationary member.

The receiving part 97 is connected to an end on the downstream side in the axial direction, which is other end in the extension direction of the diffuser vane 130, which is a wing body. That is, the receiving part 97 is connected to the diffuser vane 130 at an end opposite to the diffuser vane 130 in the extension direction with respect to the side on which a pedestal part 944 is provided. The receiving part 97 extends in the circumferential direction of the rotation shaft 20. In receiving part 97, an area of an end surface on the downstream side, which is the other side in the axial direction, is formed to be larger than a sectional area in a radial cross section of the diffuser vane 130 including the axis line P. The receiving part 97 extends in the circumferential direction of the rotation shaft 20 and comes in contact with a surface of the inner diaphragm 62 which is facing the upstream side in the axial direction. Both sides of the receiving part 97 in the radial direction are formed to be longer than those of the diffuser vane 130. As shown in FIG. 9, the receiving part 97 of one or more embodiments has the same shape as the pedestal part 944 when viewed from downstream side in the axial direction. Specifically, the receiving part 97 extends in the circumferential direction and forms a semicircular shape centered on the axis line P. The receiving part 97 is integrally formed to sandwich the plurality of diffuser vanes 130 together with the pedestal part 944. That is, the receiving part 97 is made of the same material as that of the diffuser vane 130 and the pedestal part 944. Thus, the receiving part 97 of one or more embodiments is made of a material with higher strength level than general carbon steel, for example, SS400 and S45C.

In the inner diaphragm 62 with which the receiving part 97 comes in contact, a housing recess 98 in which the receiving part 97 is received is formed in a surface facing the upstream side in the axial direction. As shown in FIG. 8, the housing recess 98 is concave on the downstream side in the axial direction from a surface of the inner diaphragm 62 which is facing the upstream side in the axial direction such that the receiving part 97 does not protrude into the diffuser flow path 13A. That is, the housing recess 98 is formed such that the receiving part 97 is housed inside the inner diaphragm 62 and only the diffuser vane 130 is disposed in the diffuser flow path 13A. The housing recess 98 is concave in a semicircular shape centered on the axis line P according to the outer shape of the receiving part 97.

A fixing part 934 of one or more embodiments fixes the pedestal part 944 and the receiving part 97 to a stationary member main body 914 from the downstream side in the axial direction, and thus regulates a position of the guide part 924 with respect to the stationary member main body 914. The fixing part 934 includes a plurality of receiving part through-holes 934*a* through which the pedestal part 944 and the receiving part 97 penetrate in the axial direction, the recess bolt-fixing hole 932*b* formed in a surface of the recess 95 which is facing the downstream side in the axial direction, and the bolt 93*c* fixed to the recess bolt-fixing hole 932*b* of the recess 95 inserted into the receiving part through-hole 934*a*. The fixing part 934 directly fixes the pedestal part 944 to the stationary member main body 914 together with the receiving part 97 while an end surface of the pedestal part 944 which is facing the upstream side in the axial direction is in contact with a surface of the recess 95 which is facing the downstream side in the axial direction. The bolt 93*c* is disposed such that it does not protrude from an end surface of the receiving part 97 on the downstream side in the axial direction.

According to the centrifugal compressor 100 of one or more embodiments described above, an area of an end surface of the receiving part 97 which is facing the downstream side in the axial direction is formed to be larger than a sectional area in a radial cross section of the diffuser vane 130 including the axis line P. When the receiving part 97 comes in contact with the inner diaphragm 62, compared to when the diffuser vane 130 is directly fixed to the inner diaphragm 62, a contact area between the guide part 924 and the inner diaphragm 62 can be larger. Thus, during contact with the adjacent third diaphragm 9*c*, it is possible to reduce a stress received by the inner diaphragm 62 through the guide part 924. Therefore, for example, without forming the inner diaphragm 62 using a material with high strength, even if it is made of a material with low strength similarly to the stationary member main body 914, it is possible to prevent the inner diaphragm 62 from being deformed or broken. Thus, not only the stationary member main body 914 of the third diaphragm 9*c* but also the inner diaphragm 62 are made of a material with a low strength, and it is possible to reduce a region for which processing is difficult. Thus, it is possible to ensure reliable strength while further reducing processing costs.

Next, a centrifugal compressor of one or more embodiments will be described with reference to FIG. 10 and FIG. 11.

In one or more embodiments, components the same as those in the above-described embodiments are denoted with the same reference numerals and details thereof will be omitted. The centrifugal compressor of one or more embodiments is different from that of the above-described embodiments in that a stationary member including a guide part is a first diaphragm.

That is, in one or more embodiments, one diaphragm including a guide part in the axial direction is a first diaphragm, and the other diaphragm adjacent to the first diaphragm in the axial direction is an outer diaphragm.

Figure 10:
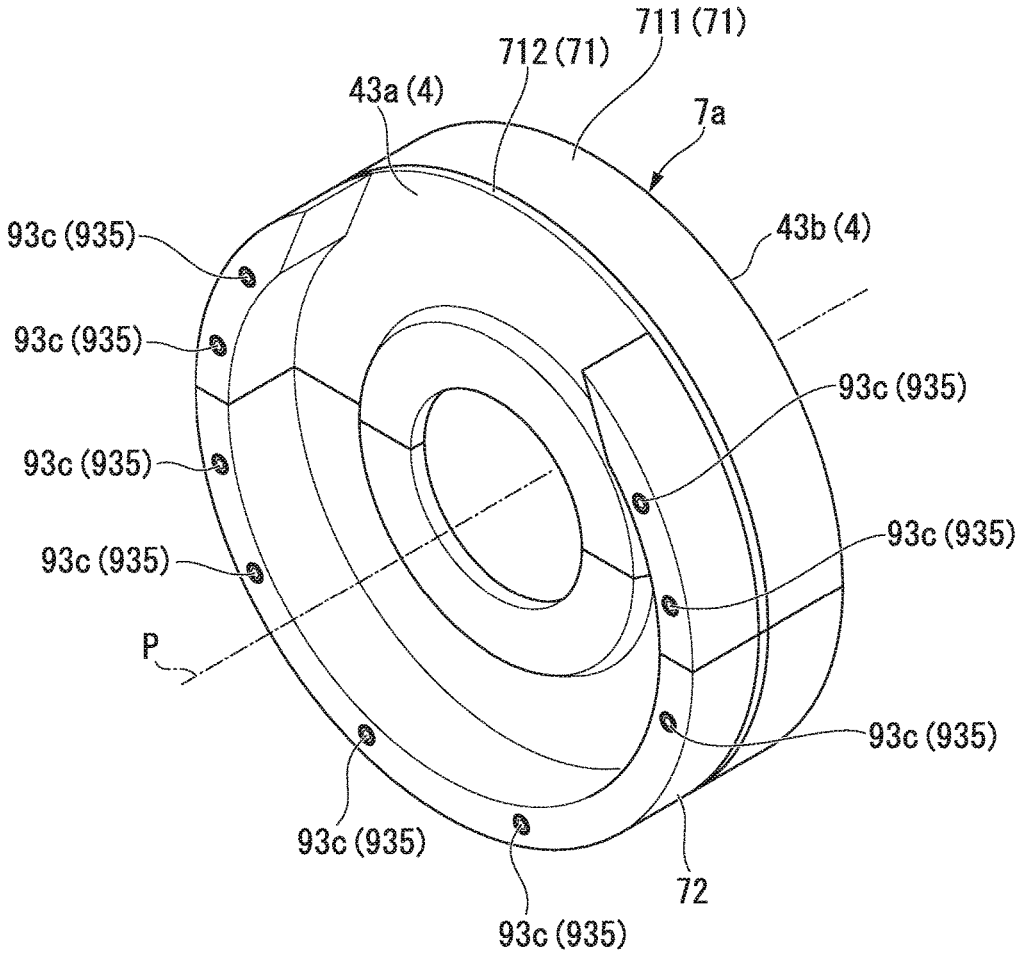
FIG. 10 is a main part sectional view describing a first diaphragm according to one or more embodiments of the present invention.

As shown in FIG. 10, a first diaphragm 7*a* of one or more embodiments includes a stationary member main body 71, a guide part 72 disposed on the upstream side in the axial direction relative to the stationary member main body 71, and a fixing part 935 for fixing the guide part 72 to the stationary member main body 71.

In the stationary member main body 71 of one or more embodiments, a space for housing the impeller 3 is formed inward in the radial direction. The stationary member main body 71 includes a first stationary member main body 711 in which the flow path-forming surface 43*b* is formed and a second stationary member main body 712 in which the flow path-forming surface 43*a* is formed.

The first stationary member main body 711 is formed in an annular shape centered on the axis line P by combining two semicircular members at a dividing surface 910*b*, and a space in which the impeller 3 and the rotation shaft 20 are housed inside the radial direction is formed. As shown in FIG. 10, the first stationary member main body 711 includes the flow path-forming surface 43*b* that is facing the downstream side in the axial direction and defines a part of the diffuser flow path 13A through which the processing gas G discharged from the impeller 3 corresponding to the first compressor stage 101 flows. Similar to the stationary member main body 91 of one or more of the above-described embodiments, the first stationary member main body 711 is made of an inexpensive material with low strength that is easily processed.

The second stationary member main body 712 is laminated on the first stationary member main body 711 on the upstream side in the axial direction. That is, the stationary member main body 71 of one or more embodiments has a structure in which the first stationary member main body 711 and the second stationary member can be separated in the axial direction. As shown in FIG. 11, the second stationary member main body 712 has the same shape as the first stationary portion main body when viewed in the axial direction. That is, the second stationary member main body 712 is formed in an annular shape centered on the axis line P by combining two semicircular members, and a space in which the impeller 3 and the rotation shaft 20 are housed is formed inward in the radial direction. As shown in FIG. 10, the second stationary member main body 712 includes the flow path-forming surface 43*a* that is facing the upstream side in the axial direction and defines a part of the suction port 11A and the suction flow path 12A. The second stationary member main body 712 is made of a material with higher strength than that of the first stationary member main body 711.

The guide part 72 is provided on the upstream side in the axial direction of the second stationary member main body 712. The guide part 72 forms an outer wall in the radial direction between the suction flow path 12A through which the processing gas G flows in the impeller flow path 30 and the suction port 11A through which the processing gas G is introduced into the suction flow path 12A from the outside of the external casing 10*a*. The guide part 72 is in contact with the outer diaphragm 61, which is another adjacent stationary member in the axial direction. The guide part 72 is made of a material with higher strength than that of the first stationary member main body 711.

Figure 11:
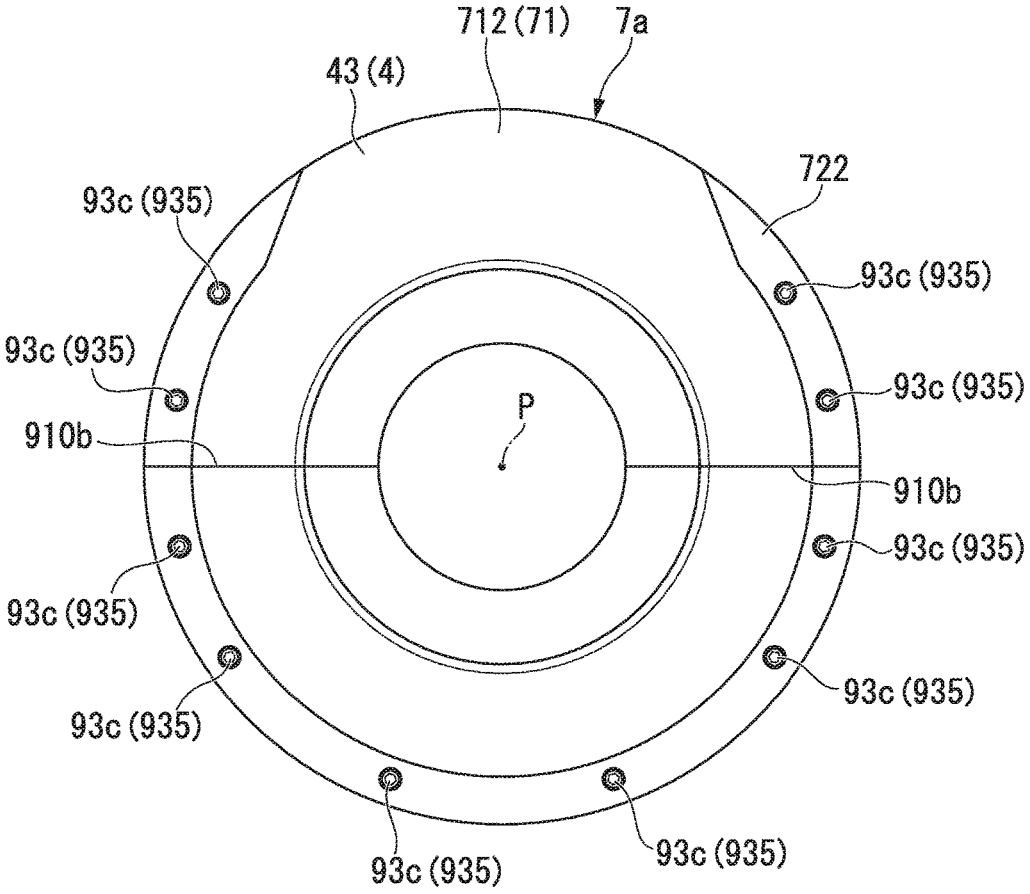
FIG. 11 is a schematic diagram of the first diaphragm according to one or more embodiments of the present invention viewed from the upstream side in an axial direction.

As shown in FIG. 11, the guide part 72 is formed along the outer circumference of the second stationary member main body 712 and defines the suction port 11A and the suction flow path 12A together with the second stationary member main body 712 inward in the radial direction. The guide part 72 forms an annular shape in which a part in the circumferential direction is cut out. The guide part 72 protrudes from a surface of the second stationary member main body 712 which is facing the upstream side in the axial direction. Specifically, the guide part 72 is formed as a smooth surface whose outer circumferential surface is continuous with the outer circumferential surface of the second stationary member main body 712. The inner circumferential surface of the guide part 72 is formed outward in the radial direction relative to the inner circumferential surface of the second stationary member main body 712. The guide part 72 forms the suction port 11A according to the part cut out in the circumferential direction. The guide part 72 forms the suction flow path 12A according to the space inward in the radial direction. In the guide part 72 of one or more embodiments, an end surface facing the upstream side in the axial direction is formed to be in contact with a surface of the outer diaphragm 61 which is facing the downstream side in the axial direction.

The fixing part 935 fixes the guide part 72 to the stationary member main body 71 and thus regulates a position of the guide part 72 with respect to the stationary member main body 71. The fixing part 935 fixes the second stationary member main body 712 and the guide part 72 to the first stationary member main body 711 using a fastening member such as the bolt 93*c*. The fixing part 935 of one or more embodiments fixes the guide part 72 and the second stationary member main body 712 to the first stationary member main body 711 by the bolt is fixing to the first stationary member main body 711 in a state of being inserted into a through hole (not shown) penetrating t the guide part 72 and the second stationary member main body 712 in the axial direction.

In the centrifugal compressor 100 of one or more embodiments described above, since there is no contact part other than the guide part 72 in a large space that forms the suction port 11A and the suction flow path 12A between the first diaphragm 7*a* and the outer diaphragm 61. Thus, a contact area with respect to a thrust force to be loaded is smaller than those of other parts and the generated stress is particularly high.

However, according to the centrifugal compressor 100 and the diaphragm 60 of one or more embodiments, the guide part 72 constituting a contact part between the first diaphragm 7*a* and the outer diaphragm 61 which are adjacent to each other is made of a material with high strength. Therefore, when the flow path-forming surface 41*b* of the adjacent outer diaphragm 61 comes in contact with the guide part 72, even if a very high stress is locally generated in the guide part 72, it is possible to prevent the guide part 72 from being deformed or broken, and it is possible to ensure reliable strength of the first diaphragm 7*a*. In addition, when the guide part 72 is made of a material with higher strength than that of the first stationary member main body 711, it is possible to reduce a region for which processing is difficult in the entire first diaphragm 7*a*. Thus, it is possible to ensure reliable strength while reducing processing costs.

Here, while the second stationary member main body 712 and the guide part 72 are formed as separate members in one or more embodiments, the present invention is not limited thereto, and the second stationary member main body 712 may be integrally formed with the guide part 72.

Embodiments of the present invention have been described in detail above with reference to the drawings, but configurations and combinations thereof in the embodiments are only examples, and additions, omissions, substitutions and other modifications of the configurations can be made without departing from the scope of the present invention. In addition, the present invention is not limited to the embodiments and is only limited by the scope of the appended claims.

Here, in the above-described embodiments, the third diaphragms 9, 9*a*, 9*b*, and 9*c* are exemplified as stationary members. However, it is not necessary for only the third diaphragm to be a stationary member including a guide part. Among the plurality of stationary members, any stationary member in which a flow path extending in the radial direction is formed when the flow path-forming surfaces 4 of two stationary members adjacent in the axial direction face each other may be used. For example, in the above-described embodiment, the outer diaphragm 61, the inner diaphragm 62, the first diaphragm 7, and the second diaphragm 8 may be stationary members including a guide part.

The receiving part 97 of one or more embodiments is not limited to the shape as in one or more embodiments, and may have any shape in which an area of a part that comes in contact with another adjacent member is larger than a sectional area in a radial cross section of the diffuser vane 130. For example, the receiving part 97 may have a shape in which an end on the downstream side in the axial direction, which is the extension direction of the diffuser vane 130, is formed to be curved so that it becomes gradually larger in the radial direction toward the downstream side in the axial direction.

The flow path is not limited to the diffuser flow paths 13A and 13B and the suction flow paths 12A and 12B as in the embodiments, and may be any flow path extending in the radial direction that is formed when the flow path-forming surfaces 4 of two adjacent stationary members face each other. Thus, for example, the flow path may be the return flow paths 15A and 15B and the discharge flow paths 16A and 16B according to the shape of the diaphragm 60.

INDUSTRIAL APPLICABILITY

According to the compressors and stationary members described above, when the guide part 92 is made of a material with higher strength than that of the stationary member main body 91, it is possible to ensure reliable strength while reducing processing costs.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

100 Centrifugal compressor
P Axis line
G Processing gas
2 Rotor
t0 Rotation shaft
3 Impeller
3A First impeller group
3B Second impeller group
31 Disk
32 Blade
33 Cover
30 Impeller flow path
101 First compressor stage
102 Second compressor stage
103 Third compressor stage
C Center position
10 Casing
10*a* External casing
10*b* Bearing
6 Diaphragm group
6A First diaphragm group
6B Second diaphragm group
60 Diaphragm
4, 41*b*, 42*a*, 43*a*, 43*b*, 44*a*, 44*b*, 45*a*, 45*b* Flow path-forming surface
61 Outer diaphragm
62 Inner diaphragm
7, 7*a* First diaphragm
8 Second diaphragm
9, 9*a*, 9*b*, 9*c* Third diaphragm
91, 912, 913, 914, 71 Stationary member main body
91*a* Impeller facing surface
911*a* Facing tapered surface
912*a* Facing end surface
91*b*, 910*b* Dividing surface
92, 922, 923, 924, 72 Guide part
93, 932, 934, 935 Fixing part
93*a* Wing through-hole
93*b* Bolt-fixing hole
93*c* Bolt
11A, 11B Suction port
12A, 12B Suction flow path
13A, 13B Diffuser flow path
130 Diffuser vane
14A, 14B Curved flow path
15A, 15B Return flow path
150 Return vane
16A, 16B Discharge flow path
17A, 17B Discharge port
95 Recess
94, 943, 944 Pedestal part
932*a* Pedestal through-hole
932*b* Recess bolt-fixing hole
96 Regulating part
961 First recess
962 Second recess
97 Receiving part
98 Housing recess
934*a* Receiving part through-hole
711 First stationary member main body
712 Second stationary member main body

The invention claimed is:

1. A compressor, comprising:

an impeller attached to a rotation shaft; and a casing covering the impeller from the outside of the rotation shaft in a radial direction, wherein the casing comprises a plurality of stationary members that are connected to each other in an axial direction of the rotation shaft and in which a flow path-forming surface toward the axial direction is formed, wherein, among the plurality of stationary members, the flow path-forming surfaces of two stationary members adjacent in the axial direction face each other to form a flow path extending in the radial direction of the rotation shaft, wherein at least one stationary member in the axial direction among the adjacent stationary members comprises:

a stationary member main body in which the flow path-forming surface is formed, and a guide that is made of a material with higher strength than that of the stationary member main body is provided on the flow path-forming surface, and guides a fluid that flows through the flow path, wherein the flow path-forming surface is connected to an end in the axial direction of an impeller-facing surface of the stationary member main body opposed to a radially outwardly facing surface of the impeller and is toward the axial direction, so as to define at least a portion of the flow path, wherein the guide comprises a wing body that is provided to protrude in the axial direction relative to the flow path-forming surface and is disposed in the flow path, wherein the guide comprises a pedestal that is connected to one end of the wing body in an extension direction, extends in a circumferential direction of the rotation shaft, and is fixed to the stationary member main body, and wherein the pedestal is formed such that an area of one end surface in the axial direction is larger than a sectional area in a surface orthogonal to the wing body in the axial direction.

2. The compressor according to claim 1, wherein the guide comprises a receiver that is connected to the other end of the wing body in the extension direction and extends in the circumferential direction of the rotation shaft, and wherein the receiver is formed such that an area of the other end surface in the axial direction is larger than a sectional area in a surface orthogonal to the wing body in the axial direction.

3. A compressor, comprising:

an impeller attached to a rotation shaft; and a casing covering the impeller from the outside of the rotation shaft in a radial direction, wherein the casing comprises a plurality of stationary members that are connected to each other in an axial direction of the rotation shaft and in which a flow path-forming surface toward the axial direction is formed, wherein, among the plurality of stationary members, the flow path-forming surfaces of two stationary members adjacent in the axial direction face each other to form a flow path extending in the radial direction of the rotation shaft, wherein at least one stationary member in the axial direction among the adjacent stationary members comprises:

a stationary member main body in which the flow path-forming surface is formed, and a guide that is made of a material with higher strength than that of the stationary member main body is provided on the flow path-forming surface, and guides a fluid that flows through the flow path, and wherein the guide forms a suction flow path through which the fluid flows in the impeller and a suction port through which the fluid is introduced into the suction flow path from outside of the casing.

4. The compressor according to claim 3, wherein the stationary member main body comprises a regulator that regulates a movement of the guide toward the flow path in the axial direction.

5. A compressor, comprising:

an impeller attached to a rotation shaft; and a casing covering the impeller from the outside of the rotation shaft in a radial direction, wherein the casing comprises a plurality of stationary members that are connected to each other in an axial direction of the rotation shaft and in which a flow path-forming surface toward the axial direction is formed, wherein, among the plurality of stationary members, the flow path-forming surfaces of two stationary members adjacent in the axial direction face each other to form a flow path extending in the radial direction of the rotation shaft, wherein at least one stationary member in the axial direction among the adjacent stationary members comprises:

a stationary member main body in which the flow path-forming surface is formed, and a guide that is made of a material with higher strength than that of the stationary member main body is provided on the flow path-forming surface, and guides a fluid that flows through the flow path, and wherein the stationary member main body comprises a regulator that regulates a movement of the guide toward the flow path in the axial direction.

6. The compressor according to claim 5, wherein the flow path-forming surface is connected to an end in the axial direction of an impeller-facing surface of the stationary member main body opposed to a radially outwardly facing surface of the impeller and is toward the axial direction, so as to define at least a portion of the flow path, and wherein the guide comprises a wing body that is provided to protrude in the axial direction relative to the flow path-forming surface and is disposed in the flow path.

7. The compressor according to claim 6, wherein the guide comprises a pedestal that is connected to one end of the wing body in an extension direction, extends in a circumferential direction of the rotation shaft, and is fixed to the stationary member main body, and wherein the pedestal is formed such that an area of one end surface in the axial direction is larger than a sectional area in a surface orthogonal to the wing body in the axial direction.

8. The compressor according to claim 6, wherein the guide comprises a receiver that is connected to the other end of the wing body in the extension direction and extends in the circumferential direction of the rotation shaft, and wherein the receiver is formed such that an area of the other end surface in the axial direction is larger than a sectional area in a surface orthogonal to the wing body in the axial direction.

9. The compressor according to claim 7, wherein the guide comprises a receiver that is connected to the other end of the wing body in the extension direction and extends in the circumferential direction of the rotation shaft, and wherein the receiver is formed such that an area of the other end surface in the axial direction is larger than a sectional area in a surface orthogonal to the wing body in the axial direction.

* * * * *